US010051362B2

(12) United States Patent
Koo

(10) Patent No.: US 10,051,362 B2
(45) Date of Patent: Aug. 14, 2018

(54) LOUDSPEAKER DEVICE

(71) Applicant: Leslie C. Koo, Taipei (TW)

(72) Inventor: Leslie C. Koo, Taipei (TW)

( * ) Notice: Subject to any disclaimer, the term of this patent is extended or adjusted under 35 U.S.C. 154(b) by 0 days.

(21) Appl. No.: 15/446,053

(22) Filed: Mar. 1, 2017

(65) Prior Publication Data

US 2018/0160222 A1 Jun. 7, 2018

(30) Foreign Application Priority Data

Dec. 1, 2016 (CN) ..... 2016 2 1310820 U

(51) Int. Cl.
*H04R 1/02* (2006.01)
*H04R 1/40* (2006.01)

(52) U.S. Cl.
CPC ..... *H04R 1/403* (2013.01); *H04R 1/023* (2013.01)

(58) Field of Classification Search
None
See application file for complete search history.

(56) References Cited

U.S. PATENT DOCUMENTS 4,006,308 A * 2/1977 Ponsgen ..... H04R 1/26 181/147
5,502,772 A * 3/1996 Felder ..... H04R 1/20 181/199
8,967,323 B1 * 3/2015 Grenier ..... H04R 1/26 181/198
2007/0242844 A1 * 10/2007 Harman ..... H04R 19/02 381/191
2007/0263888 A1 * 11/2007 Melanson ..... H04S 3/00 381/300
2010/0166212 A1 * 7/2010 Ishibashi ..... H04R 1/403 381/92
2012/0014544 A1 * 1/2012 Gladwin ..... H04R 3/12 381/304
2014/0105444 A1 * 4/2014 Kaetel ..... H04S 7/30 381/386
2014/0126753 A1 * 5/2014 Takumai ..... H04S 7/305 381/303
2015/0172822 A1 * 6/2015 Jenq ..... H04R 9/063 381/401

* cited by examiner

*Primary Examiner* — Curtis Kuntz
*Assistant Examiner* — Qin Zhu
(74) *Attorney, Agent, or Firm* — McClure, Qualey & Rodack, LLP

(57) ABSTRACT

A loudspeaker device is provided, including a first speaker module, a second speaker module, and a third speaker module. The first speaker module includes first, second, third, fourth, and fifth speaker units facing different directions. The second speaker module includes a sixth speaker unit, and the third speaker module includes a seventh speaker unit. The first, second, third, fourth, fifth, sixth, and seventh speaker units are arranged along a central axis of the loudspeaker device, and the output sound frequencies of the first, second, and third speaker units are less than those of the fourth, fifth, sixth, and seventh speaker units.

9 Claims, 13 Drawing Sheets

LOUDSPEAKER DEVICE

CROSS REFERENCE TO RELATED APPLICATIONS

This Application claims priority of China Patent Application No. 201621310820.1, filed on Dec. 1, 2016, the entirety of which is incorporated by reference herein.

BACKGROUND OF THE DISCLOSURE

Field of the Invention

The present invention relates to a loudspeaker device, and more particularly to a modularized loudspeaker device.

Description of the Related Art

As consumer electronic technologies progress, users increasingly demand better sound quality from their audio equipment. Loudspeakers are usually a significant factor in determining the sound quality of such equipment. In conventional audio equipment, several loudspeakers may be applied in a speaker system. To simulate a point sound source which can generate an omnidirectional sound field, and thereby provide a better listening experience, the trend has been to develop speaker systems that integrate several speaker units of different output sound frequencies into a single speaker device. However, conventional speaker devices are not easy to assemble and deliver since they are usually considerably large. Hence, providing a modularized loudspeaker device which is easy to assemble and deliver has become an important issue.

BRIEF SUMMARY OF THE DISCLOSURE

Accordingly, one objective of the present invention is to provide a loudspeaker device including a first speaker module, a second speaker module, and a third speaker module. The first speaker module includes first, second, third, fourth, and fifth speaker units facing different directions. The second speaker module includes a sixth speaker unit, and the third speaker module includes a seventh speaker unit. The first, second, third, fourth, fifth, sixth, and seventh speaker units are arranged along a central axis of the loudspeaker device, and the output sound frequencies of the first, second, and third speaker units are less than those of the fourth, fifth, sixth, and seventh speaker units.

According to some embodiments of the disclosure, the first speaker module has two first speaker units, a first plate, and a second plate which are perpendicular to each other and form a cross-shaped structure, wherein the first speaker units are disposed on the first plate, and the second and third speaker units are disposed on the second plate.

According to some embodiments of the disclosure, the first plate has an H-shaped structure with two recesses, the second plate has a U-shaped structure with two protrusions extended through the recesses, and the second and third speaker units are disposed on the respective protrusions.

According to some embodiments of the disclosure, the first speaker module further has a third plate that is parallel to the first plate and disposed on the rear side of the first speaker units, wherein the width of the third plate is less than that of the first plate.

According to some embodiments of the disclosure, the first speaker module further has a fourth plate and a fifth plate which are disposed on opposite sides of the first speaker module and are connected to the first and second plates, wherein the fourth and fifth speaker units are respectively disposed on the fourth and fifth plates.

According to some embodiments of the disclosure, the second speaker module further has an upper housing, and the third speaker module further has a lower housing, wherein the fourth and sixth speaker units are received in the upper housing, and the fifth and seventh speaker units are received in the lower housing.

According to some embodiments of the disclosure, the second speaker module further has a sixth plate connected to the upper housing and adjacent to the fourth speaker unit, and the third speaker module further has a seventh plate connected to the lower housing and adjacent to the fifth speaker unit, wherein the sixth speaker unit is disposed on the sixth plate, and the seventh speaker unit is disposed on the seventh plate.

According to some embodiments of the disclosure, the second and third speaker modules respectively have a bass reflex tube, and the bass reflex tubes are respectively disposed in the upper and lower housings, corresponding to the sixth and seventh speaker units.

According to some embodiments of the disclosure, the loudspeaker device further comprises a hollow frame and a dustproof mesh, the hollow frame surrounds the first speaker module and is connected to the second and third speaker modules, and the dustproof mesh covers at least one side of the hollow frame.

Another objective of the present invention is to provide a loudspeaker device comprising two speaker modules connected to each other. One of the speaker modules comprises two first speaker units facing a first direction, a second speaker unit facing a second direction, a third speaker unit facing a direction that is opposite to the second direction, and a fifth speaker unit facing a direction that is opposite to the second direction. The first and second directions are substantially perpendicular to each other, and the first speaker units are disposed between the second and third speaker units. The other speaker module has a seventh speaker unit, and the first, second, third, fifth, and seventh speaker units are arranged along a central axis of the loudspeaker device, wherein the output sound frequencies of the first, second, and third speaker units exceed those of the fifth and seventh speaker units.

BRIEF DESCRIPTION OF THE DRAWINGS

For a more complete understanding of the embodiments, and the advantages thereof, reference is now made to the following descriptions taken in conjunction with the accompanying drawings.

DETAILED DESCRIPTION OF THE ILLUSTRATIVE EMBODIMENTS

The making and using of the embodiments of the rotary mechanisms are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood to one of ordinary skill in the art to which this invention belongs. It should be appreciated that each term, which is defined in a commonly used dictionary, should be interpreted as having a meaning conforming to the relative skills and the background or the context of the present disclosure, and should not be interpreted by an idealized or overly formal manner unless defined otherwise.

Figure 1A:
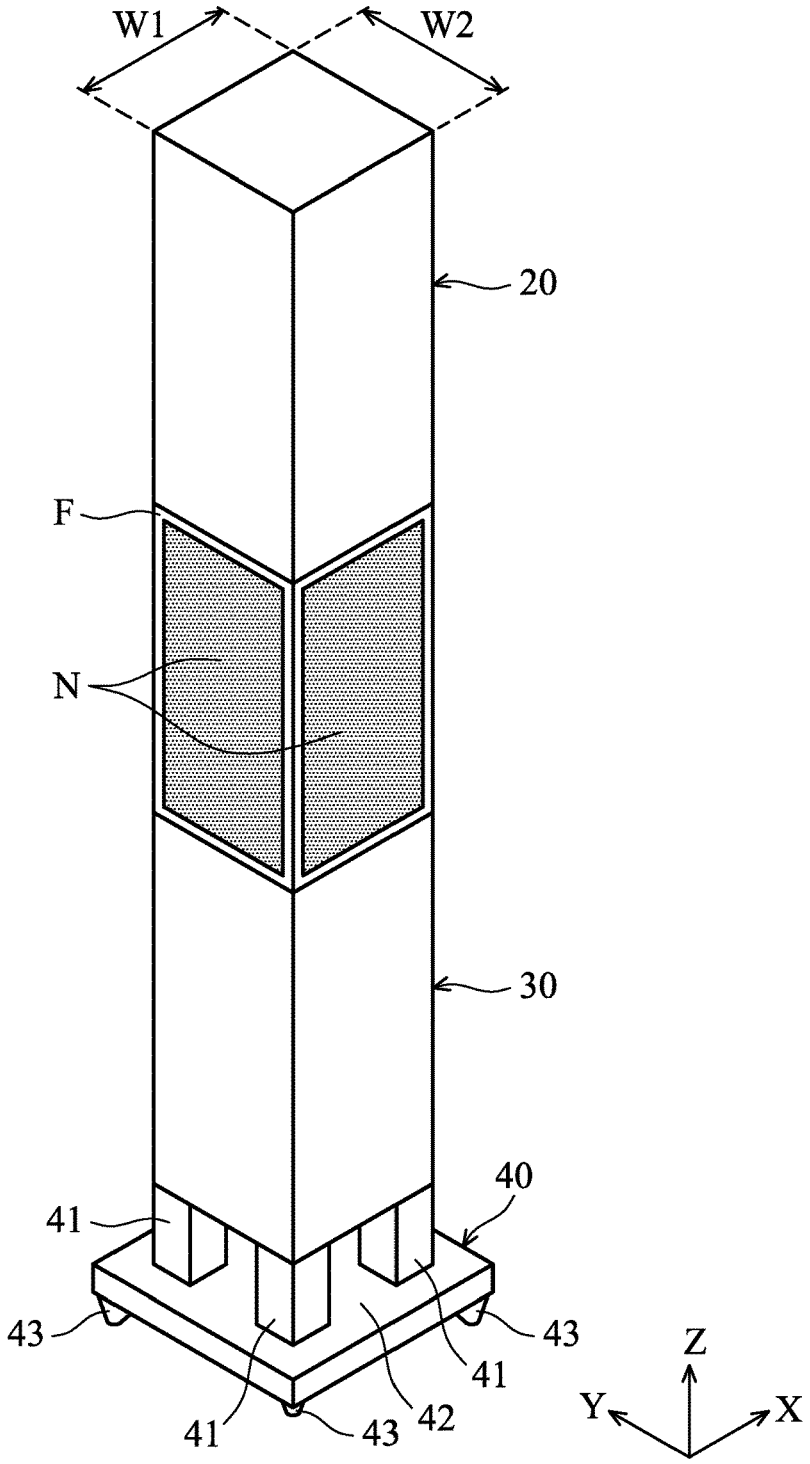
FIG. 1A is a perspective diagram showing a loudspeaker device according to an embodiment of the invention.
Figure 1B:
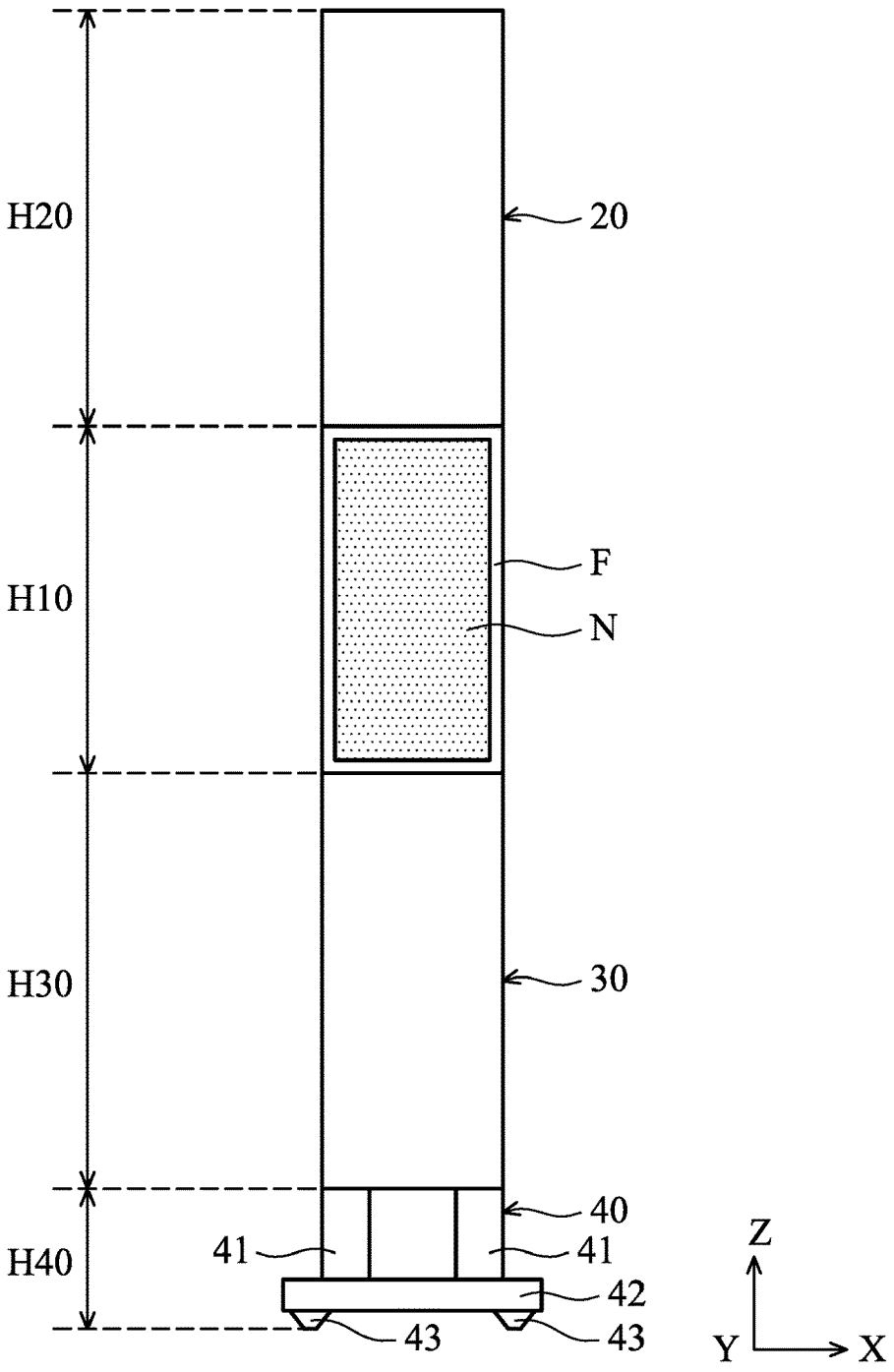
FIG. 1B is a front view of the loudspeaker device in FIG. 1A.
Figure 1C:
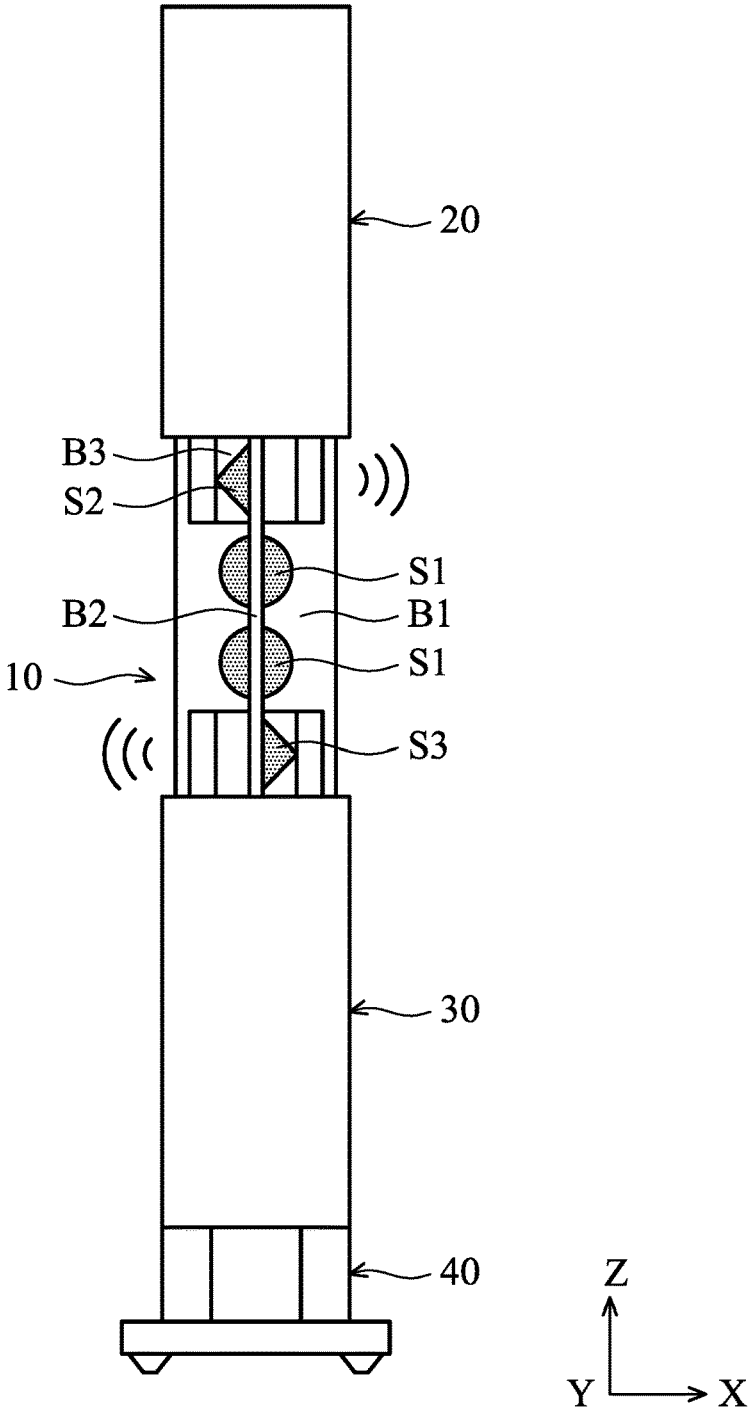
FIG. 1C is a front view the loudspeaker device in FIG. 1A with the frame F and the dustproof mesh N removed therefrom.

Referring to FIGS. 1A, 1B, and 1C, FIG. 1A is a perspective diagram showing a loudspeaker device according to an embodiment of the invention. FIG. 1B is a front view of the loudspeaker device in FIG. 1A, and FIG. 1C is a front view the loudspeaker device in FIG. 1A with the frame F and the dustproof mesh N removed therefrom. As shown in FIG. 1C, the loudspeaker device has a substantially pillar-shaped structure and primarily comprise a first speaker module 10, a second speaker module 20, a third speaker module 30, and a base module 40. Specifically, the first speaker module 10, the second speaker module 20, and the third speaker module 30 are arranged along a central axis (parallel to the Z axis) of the loudspeaker device, and the first speaker module 10 is disposed between the second and third speaker modules 20 and 30.

In this embodiment, a rectangular frame F and a dustproof mesh N are disposed surrounding the first speaker module 10, as shown in FIGS. 1A and 1B. The dustproof mesh N is attached to at least one side of the frame F (or encompasses all four sides of the frame F). Additionally, the frame F surrounds the first speaker module 10 and is connected to the second and third speaker modules 20 and 30. The frame F can improve the structural strength of the loudspeaker device, and the propagation of acoustic waves in the front, back, left and right directions can be allowed through the dustproof mesh N, so as to generate an omnidirectional sound field as a point sound source for a better listening experience.

Referring to FIGS. 1A and 1B, the base module 40 primarily comprises four pillars 41, a base plate 42, and four stand feet 43. The pillars 41 connect the third speaker module 30 with the base plate 42, and the stand feet 43 are disposed beneath the base plate 42 and in contact with the ground, whereby the loudspeaker device can stand erect on the ground. As depicted in FIG. 1A, the first, second, and third speaker modules 10, 20 and 30 have a width W1 along the X axis and a width W2 along the Y axis, wherein the widths W1 and W2 are substantially 25 cm. Moreover, as depicted in FIG. 1B, the first, second, and third speaker modules 10, 20, 30 and the base module 40 respectively have heights of H10, H20, H30, and H40, wherein H10=47 cm, H20=56.5 cm, H30=56.5 cm, and H40=20 cm. Thus, the total height of the loudspeaker device can be close to half the height of an adult person, so as to provide excellent sound quality for users. However, the aforementioned dimensions of the loudspeaker device can also be adjusted depending on practical design requirements and are not limited by the embodiments.

Figure 1D:
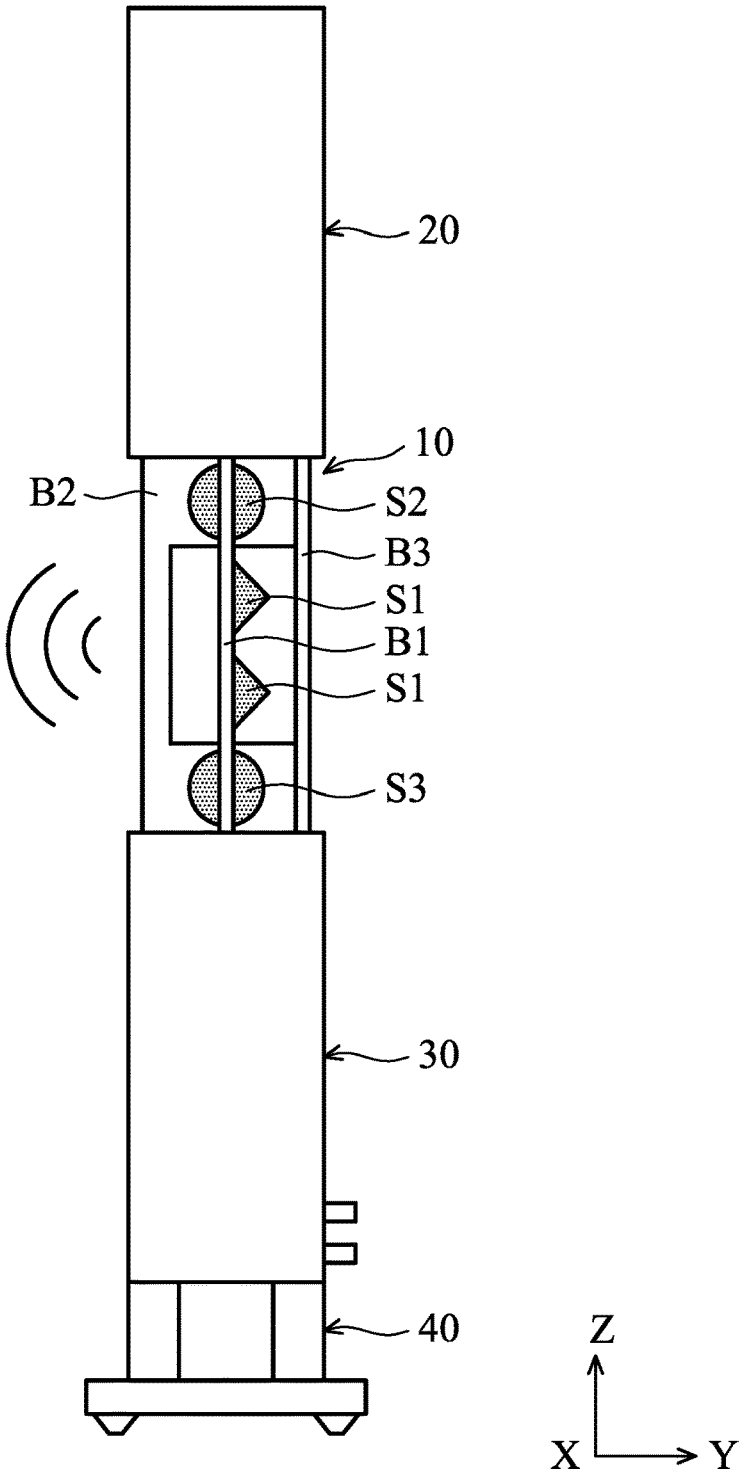
FIG. 1D is a front view the loudspeaker device in FIG. 1A with the frame F and the dustproof mesh N removed therefrom.

Referring to FIGS. 1C and 1D, FIG. 1D is a side view of the loudspeaker device in FIG. 1A with the frame F and the dustproof mesh N removed therefrom. As shown in FIG. 1C, the first speaker module 10 in this embodiment primarily comprises at least a first speaker unit S1, a second speaker unit S2, and a third speaker unit S3. Here, two first speaker units S1 are provided and oriented toward the −Y direction (first direction). The second speaker unit S2 is oriented toward the X direction (second direction), and the third speaker unit S3 is oriented toward the −X direction (opposite to the second direction). Thus, the acoustic wave can propagate in different directions to generate an omnidirectional sound field.

As shown in FIGS. 1C and 1D, the first speaker units S1 are disposed on a first plate B1, the second and third speaker units S2 and S3 are disposed on a second plate B2, and the first speaker units S1 are situated between the second and third speaker units S2 and S3. Specifically, the first and second plates B1 and B2 are perpendicular to each other and form a cross-shaped structure. FIG. 1D further shows a third plate B3 disposed on a rear side of the first plate B1. The third plate B3 is substantially parallel to the first plate B1 and connected to the second plate B2, wherein the width of the third plate B3 along the X axis is less than that of the first plate B1 along the X axis. Thus, the structural strength of the loudspeaker device can be enhanced, and the acoustic wave from the speaker units can propagate to the outside smoothly through the spaces between the plates without obstruction, thereby providing comprehensive sound coverage and facilitating a better listening experience.

Figure 2A:
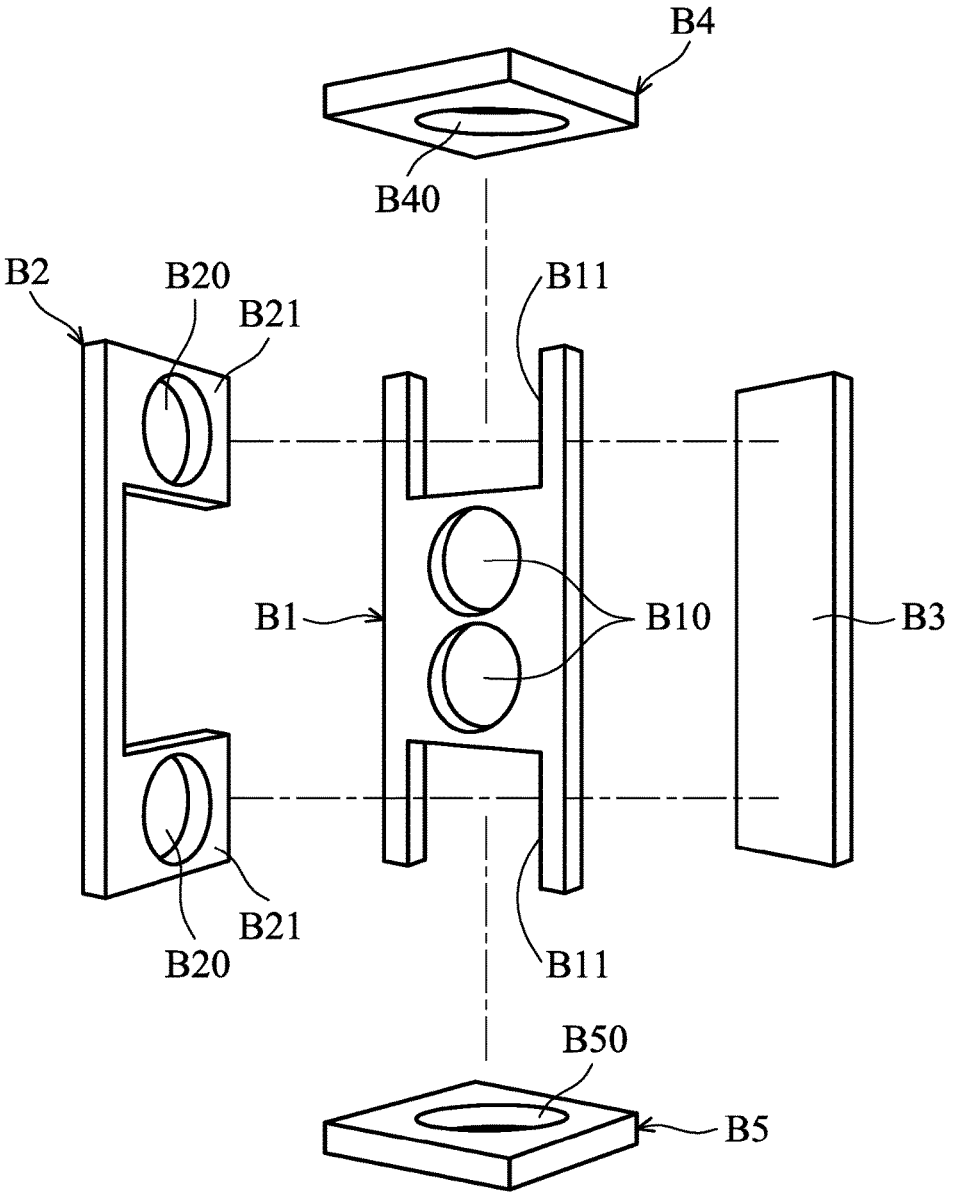
FIG. 2A shows an exploded view of several plates of the first speaker module 10 according to an embodiment of the invention.
Figure 2B:
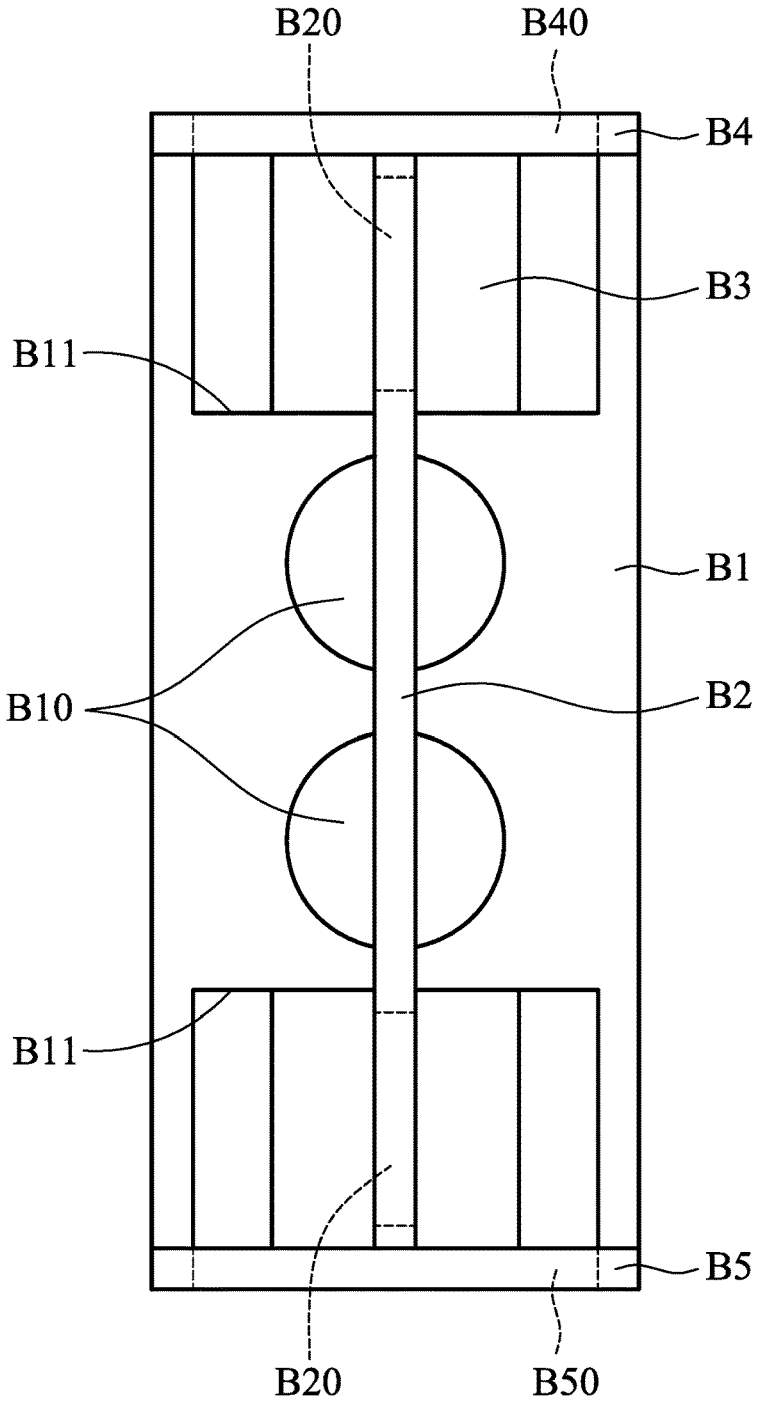
FIG. 2B shows a front view of the plates in FIG. 2A after assembly.
Figure 2C:
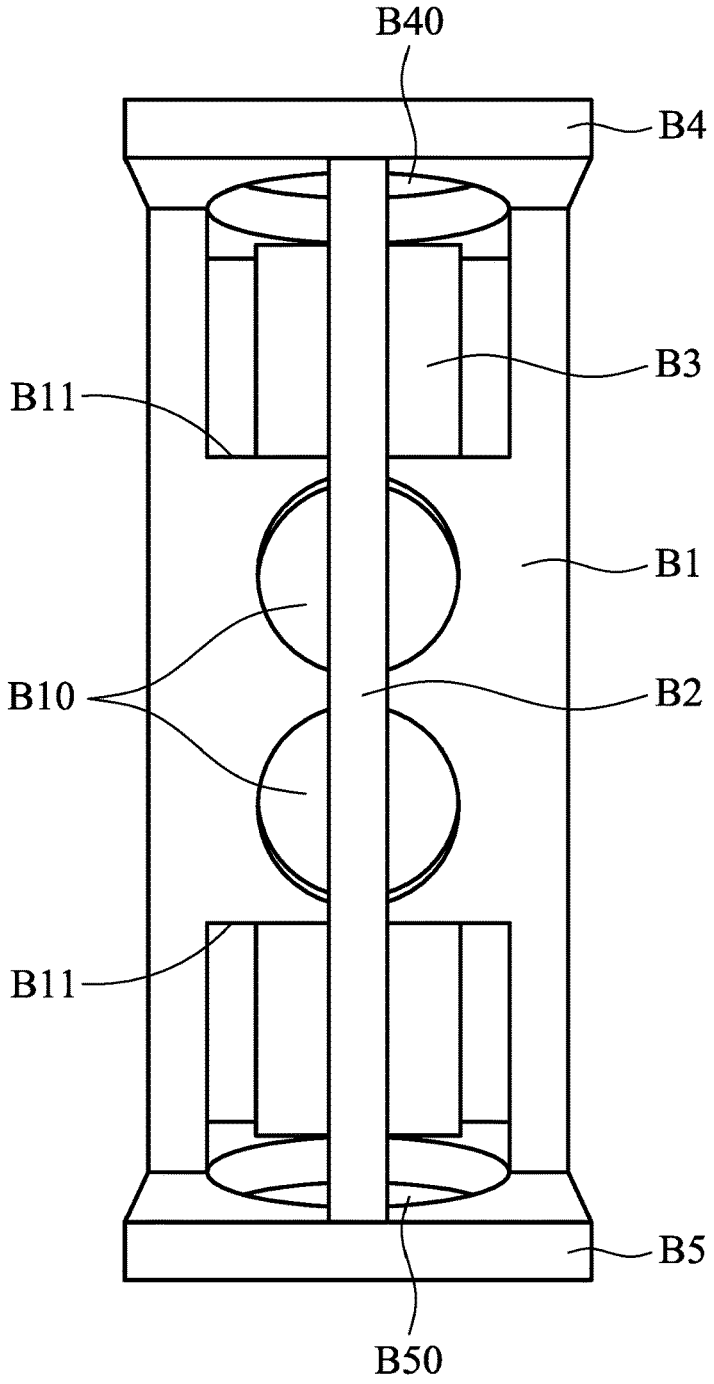
FIGS. 2C-2D are perspective diagrams of the plates in FIG. 2A after assembly.
Figure 2D:
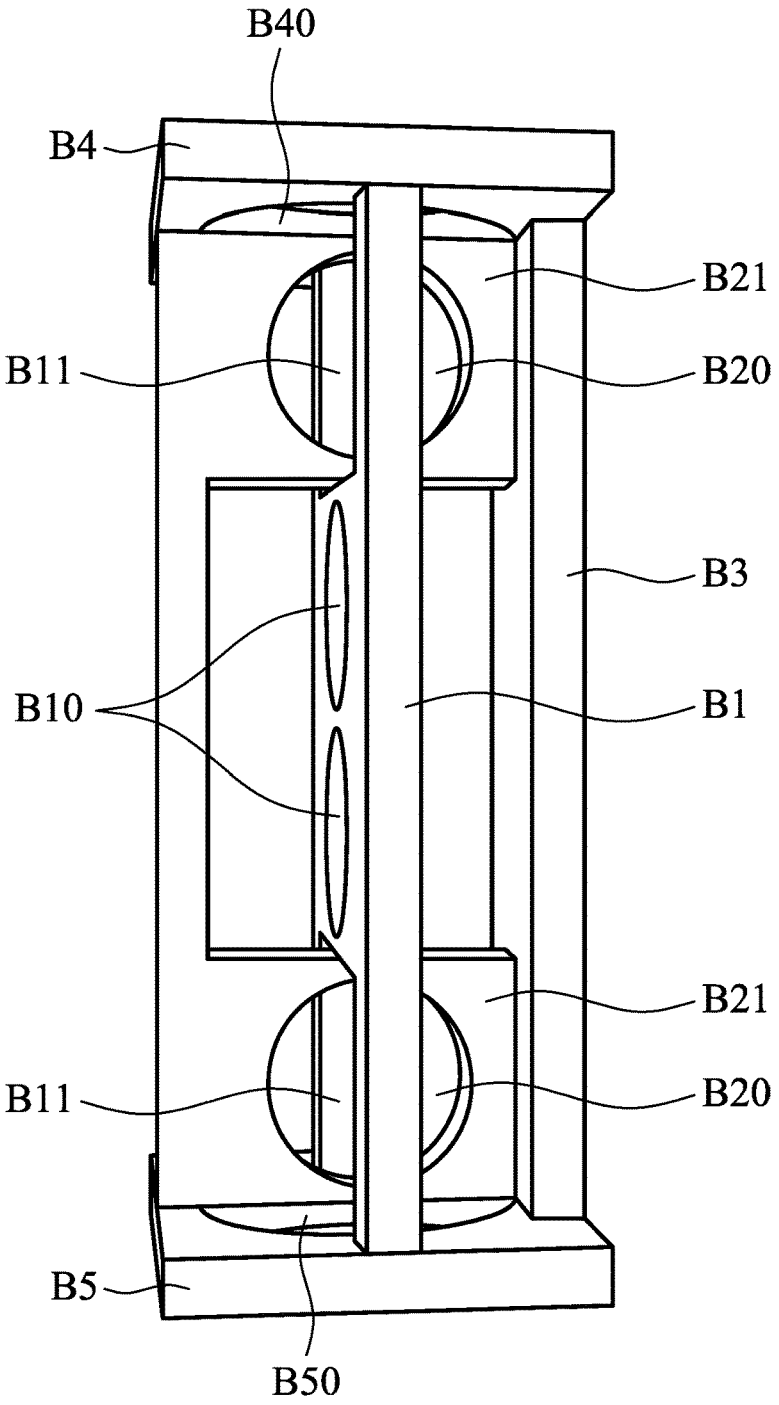

Referring to FIGS. 2A to 2D, besides the first, second, and third plates, B1, B2, and B3, the first speaker module 10 further comprises a fourth plate B4 and a fifth plate B5. The fourth and fifth plates B4 and B5 are respectively disposed on the top and bottom sides of the first, second, and third plates, B1, B2, and B3. Here, the fourth and fifth plates B4 and B5 respectively form an opening B40 and an opening B50 for accommodating different speaker units. As shown in FIGS. 2A to 2D, the first plate B1 has an H-shaped structure forming two recesses B11, and correspondingly, the second plate B2 has a U-shaped structure with two protrusions B21 extended through the recesses B11 (FIG. 2D). Thus, the first and second plates B1 and B2 can be connected to form a cross-shaped structure. Subsequently, the first speaker units S1 can be mounted to two openings B10 on the first plate B1, and the second and third speaker units S2 and S3 can be mounted to two openings B20 on the second plate B2, so that the acoustic wave generated from the speaker units can propagate in different directions.

Figure 3A:
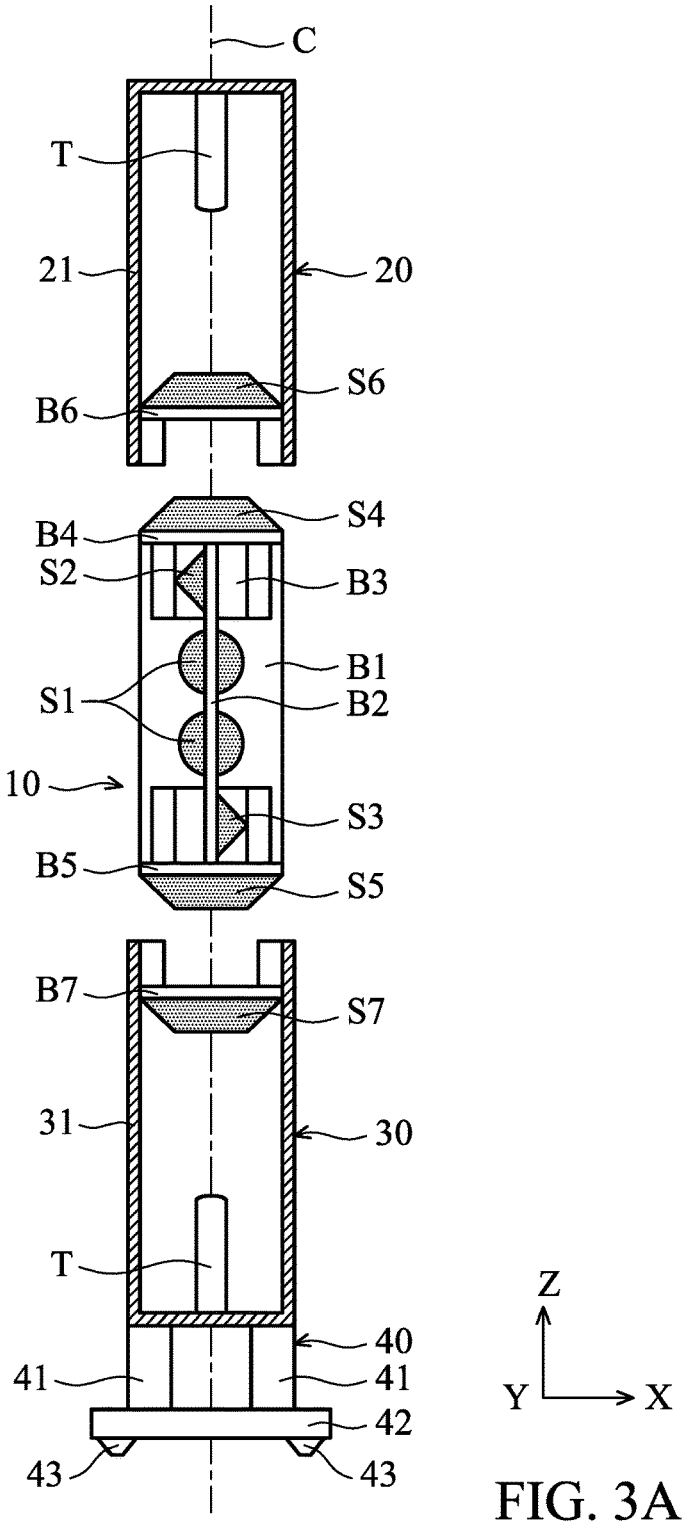
FIG. 3A shows an exploded view of the loudspeaker device in FIG. 1C, wherein the upper and lower housings 21 and 31 of the second and third speaker nodules 20 and 30 are illustrated by cross-sectional views.
Figure 3B:
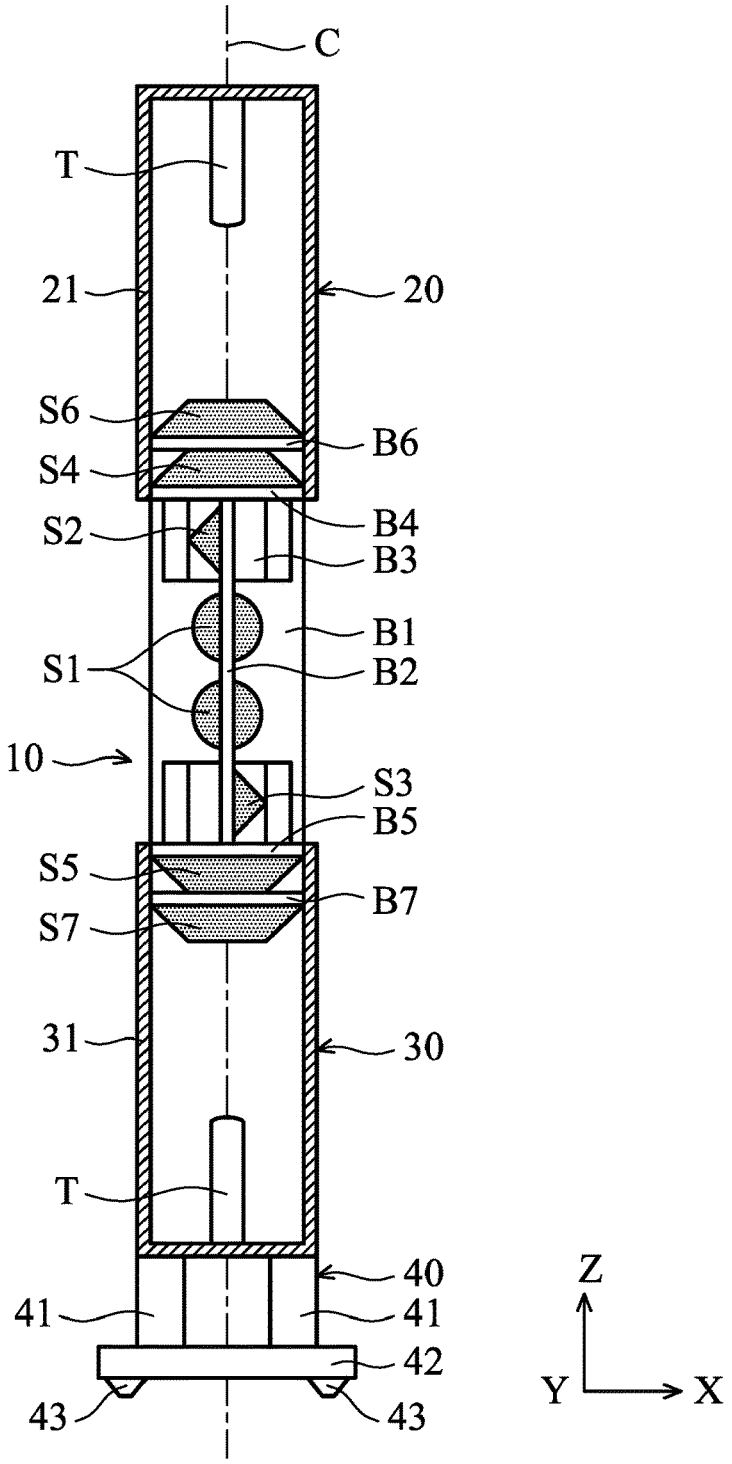
FIG. 3B is a perspective diagram showing the loudspeaker device in FIG. 3A after assembly.

Referring to FIGS. 3A and 3B, the first speaker module 10 in this embodiment further has a fourth speaker unit S4 and a fifth speaker unit S5 respectively disposed on the fourth and fifth plates B4 and B5. The fourth speaker unit S4 is oriented toward the −Z direction (third direction), and the fifth speaker unit S5 is oriented toward the Z direction (opposite to the third direction). As the first, second, third, fourth, and fifth speaker units S1 to S5 are arranged in a symmetrical manner, the acoustic wave can smoothly propagate to the outside in various directions through the hollow structure formed by the plates, so as to generate an omnidirectional sound field as a point sound source for a better listening experience. In some embodiments, the first, second, and third speaker units S1, S2 and S3 may be tweeter, midrange, or full-range speaker units, such as SEAS FU10RB-8 speaker drivers, which are arranged between the fourth and fifth speaker units S4 to S5.

Still referring to FIGS. 3A and 3B, the second speaker module 20 has an upper housing 21, and the third speaker module 30 has a lower housing 31. A sixth speaker unit S6 is disposed on a sixth plate B6 in the upper housing 21 and oriented toward the −Z direction (third direction). A seventh speaker S7 is disposed on a seventh plate B7 in the lower housing 31 and oriented toward the Z direction (opposite to the third direction). In this embodiment, two bass reflex tube T are respectively disposed in the upper and lower housings 21 and 31, which are positioned and oriented corresponding to the sixth and seventh speakers S6 and S7. After assembly of the loudspeaker device, the fourth and sixth speaker units S4 and S6 are received in the upper housing 21, the fifth and seventh speaker units S5 and S7 are received in the lower housing 31, and the first, second, third, fourth, fifth, sixth, and seventh speaker units S1 to S7 are arranged along a central axis C (parallel to the Z axis) of the loudspeaker device.

Figure 3C:
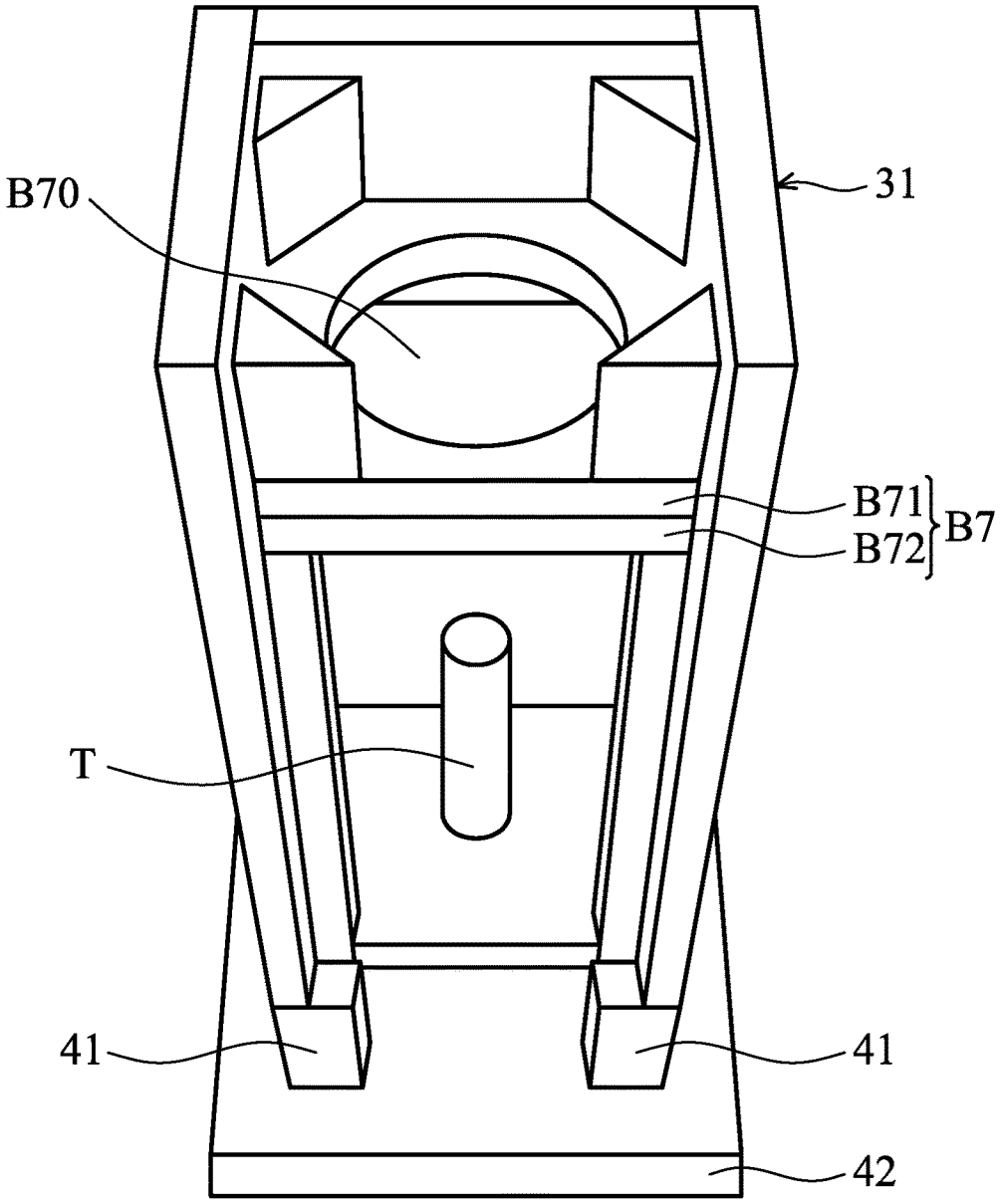
FIG. 3C is a perspective diagram showing the interior structure of the lower housing 31, wherein a plate on a side thereof is omitted.

As depicted in FIG. 3C, the lower housing 31 is formed by several plates, wherein a plate on one side of the lower housing 31 is omitted for clear illustration of the inner mechanisms. The seventh plate B7 in FIG. 3C is a multilayer plate which is constructed by two thin plates B71 and B72. The seventh plate B7 has an opening B70 for propagation of acoustic waves from the speaker unit S7 to the outside. As the sixth plate B6 has a structure that is the same as that of the seventh plate B7, the description thereof is omitted. In this embodiment, the fourth, fifth, sixth, and seventh speaker units S4 TO S7 can be woofers or subwoofers, such as Seas L16RN-SL speaker drivers, which have output sound frequencies that are higher than the first, second, and third speaker units S1 to S3.

Figure 4A:
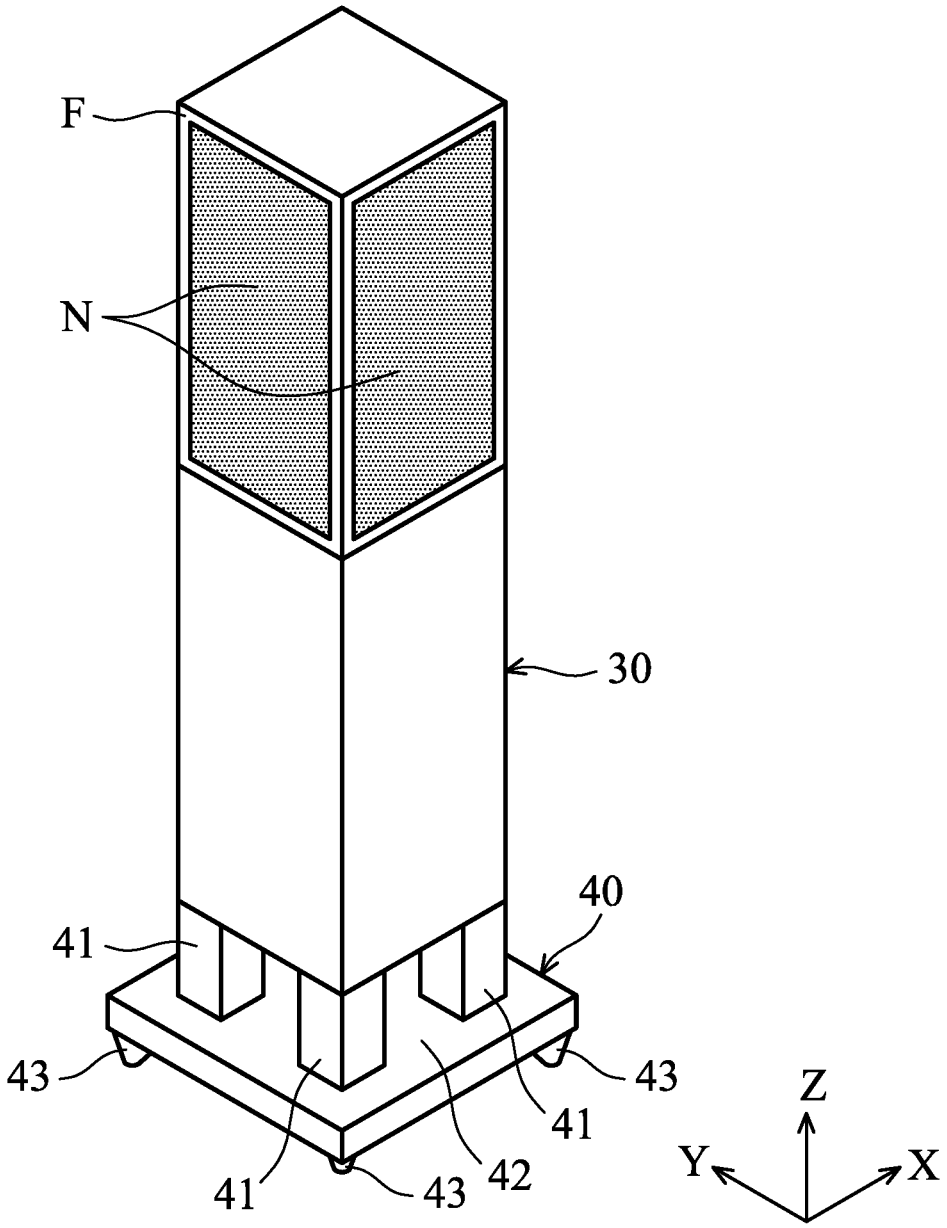
FIG. 4A is a perspective diagram showing a loudspeaker device according to another embodiment of the invention.
Figure 4B:
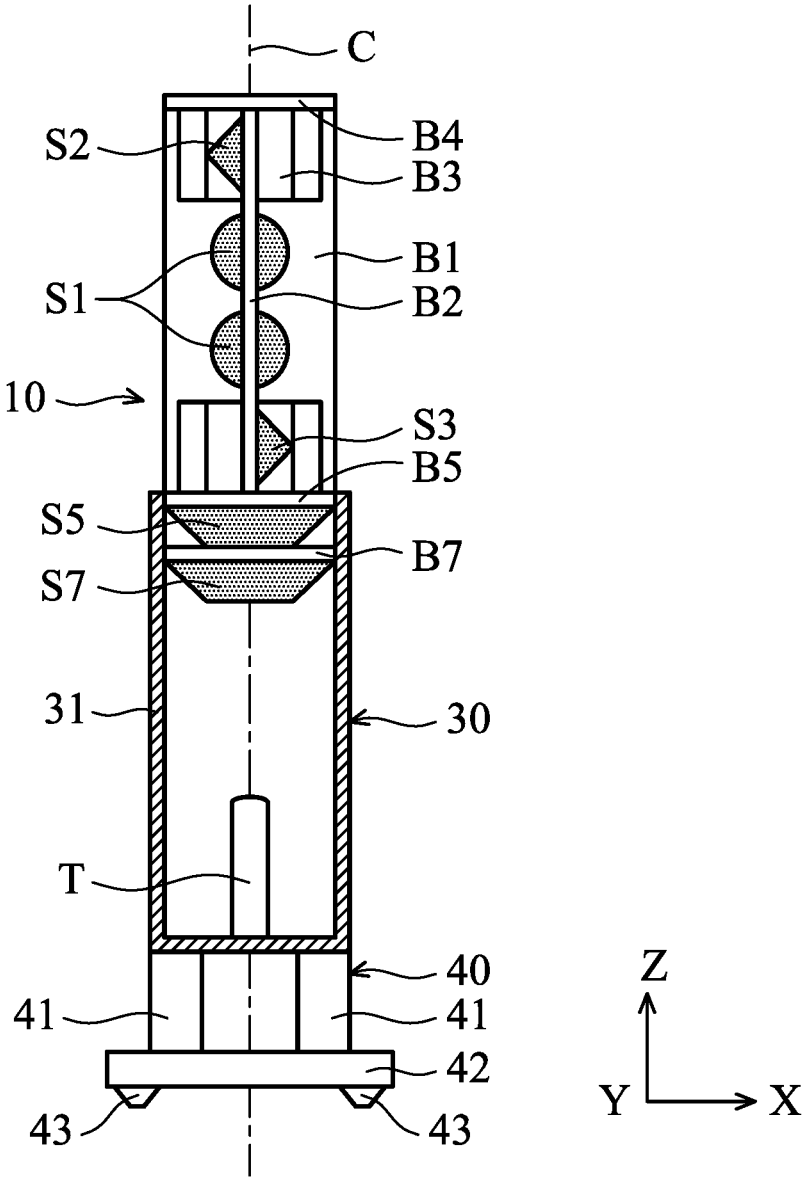
FIG. 4B is a front view showing the interior structure of the loudspeaker device in FIG. 1A with the frame F and the dustproof mesh N removed therefrom.

FIGS. 4A and 4B show a loudspeaker device according to another embodiment of the invention. The loudspeaker device in FIGS. 4A and 4B primarily comprises a first speaker module 10, a third speaker module 30, and a base module 40. As the speaker module 20 shown in FIGS. 1A to 1C is omitted in the present embodiment, the height of the loudspeaker device can be reduced to save space. In some embodiments, the base module 40 may also be omitted from the loudspeaker device, so that the third speaker module 30 can be directly disposed on the ground. Specifically, a rectangular frame F and a dustproof mesh N can be disposed surrounding the first speaker module 10, as shown in FIGS. 4A and 4B. The dustproof mesh N is attached to at least one side of the frame F (or encompassing all four sides of the frame F), and the frame F is connected to the third speaker module 30 under the first speaker module 10.

Still referring to FIG. 4B, the loudspeaker device in this embodiment includes a base module 40 and only two speaker modules (the first and third speaker modules 10 and 30). The two speaker modules have a total of six speaker units, including two first speaker units S1, a second speaker unit S2, a third speaker unit S3, a fifth speaker unit S5, and a seventh speaker unit S7, wherein the fourth and sixth speaker units S4 and S6 shown in FIG. 3B are omitted in this embodiment. It should be noted that the six speaker units are substantially arranged along a central axis C of the loudspeaker device. The first, second, and third speaker units S1, S2 and S3 may be tweeter, midrange, or full-range speaker units, such as SEAS FU10RB-8 speaker drivers, and the output sound frequencies of the fifth and seventh speaker units S5 and S7 are higher than those of the first, second, and third speaker units S1 to S3. Thus, an omnidirectional sound field can be generated as a point sound source for a better listening experience. According to this embodiment, since the loudspeaker device includes only two speaker modules which can be assembled in a modular manner, cost reduction, easy delivery, and space saving can be achieved.

In summary, the present invention provides a loudspeaker device which can stand erect on the ground. As the loudspeaker device can be assembled in a modular manner, it is not only easy to deliver, but also suitable for various environments and uses when applying different speaker units, so as to facilitate easy assembly and cost reduction. Additionally, by arranging the speaker units along a central axis of the loudspeaker device, an omnidirectional sound field can be generated as a point sound source for a better listening experience. Specifically, as the loudspeaker device of the invention can have more compact dimensions than a conventional speaker system, it is particularly suitable for home theaters and performance rooms.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

Use of ordinal terms such as "first", "second", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A loudspeaker device, comprising:

a first speaker module, comprising two first speaker units facing a first direction, a second speaker unit facing a second direction, a third speaker unit facing a direction that is opposite to the second direction, a fourth speaker unit facing a third direction, and a fifth speaker unit facing a direction that is opposite to the third direction, wherein the first, second, and third directions are perpendicular to each other, and the first, second, and third speaker units are disposed between the fourth and fifth speaker units;

a second speaker module, having a sixth speaker unit facing the third direction; and a third speaker module, having a seventh speaker unit facing the direction that is opposite to the third direction, wherein the first, second, third, fourth, fifth, sixth, and seventh speaker units are arranged along a central axis of the loudspeaker device, and the output sound frequencies of the first, second, and third speaker units exceed those of the fourth, fifth, sixth, and seventh speaker units.

2. The loudspeaker device as claimed in claim 1, wherein the first speaker module has a first plate and a second plate which are perpendicular to each other and form a cross-shaped structure, wherein the first speaker units are disposed on the first plate, and the second and third speaker units are disposed on the second plate.

3. The loudspeaker device as claimed in claim 2, wherein the first plate has an H-shaped structure with two recesses, the second plate has a U-shaped structure with two protrusions extended through the recesses, and the second and third speaker units are respectively disposed on the protrusions.

4. The loudspeaker device as claimed in claim 3, wherein the first speaker module further has a third plate that is parallel to the first plate and disposed on a rear side of the first speaker units, wherein the width of the third plate is less than that of the first plate.

5. The loudspeaker device as claimed in claim 2, wherein the first speaker module further has a fourth plate and a fifth plate which are disposed on opposite sides of the first speaker module and are connected to the first and second plates, wherein the fourth and fifth speaker units are respectively disposed on the fourth and fifth plates.

6. The loudspeaker device as claimed in claim 1, wherein the second speaker module further has an upper housing, and the third speaker module further has a lower housing, wherein the fourth and sixth speaker units are received in the upper housing, and the fifth and seventh speaker units are received in the lower housing.

7. The loudspeaker device as claimed in claim 6, wherein the second speaker module further has a sixth plate connected to the upper housing and adjacent to the fourth speaker unit, and the third speaker module further has a seventh plate connected to the lower housing and adjacent to the fifth speaker unit, wherein the sixth speaker unit is disposed on the sixth plate, and the seventh speaker unit is disposed on the seventh plate.

8. The loudspeaker device as claimed in claim 6, wherein the second and third speaker modules respectively have a bass reflex tube, and the bass reflex tubes are respectively disposed in the upper and lower housings, corresponding to the sixth and seventh speaker units.

9. The loudspeaker device as claimed in claim 1, wherein the loudspeaker device further comprises a hollow frame and a dustproof mesh, the hollow frame surrounds the first speaker module and is connected to the second and third speaker modules, and the dustproof mesh covers at least one side of the hollow frame.

* * * * *